US005838234A

United States Patent [19]

Roulleaux-Robin

[11] Patent Number: 5,838,234

[45] Date of Patent: Nov. 17, 1998

[54] METHOD AND DEVICE FOR SENSING, IDENTIFYING AND PROTECTING GOODS, PARTICULARLY FROM THEFT

[76] Inventor: Véronique Roulleaux-Robin, 21, rue des Sablons Chandelles 28130, Villiers Le Morhier, France

[21] Appl. No.: 702,604

[22] PCT Filed: Dec. 21, 1995

[86] PCT No.: PCT/FR95/01713

§ 371 Date: Aug. 27, 1996

§ 102(e) Date: Aug. 27, 1996

[87] PCT Pub. No.: WO96/20463

PCT Pub. Date: Jul. 4, 1996

[30] Foreign Application Priority Data

Dec. 28, 1994 [FR] France ..... 94 15765

[51] Int. Cl.[6] ..... G08B 13/14

[52] U.S. Cl. ..... 340/572; 340/568; 340/541; 340/539

[58] Field of Search ..... 340/572, 568, 340/551, 571, 539, 825.31, 825.32, 825.34

[56] References Cited

U.S. PATENT DOCUMENTS

| | | | |
|---|---|---|---|
| 3,665,448 | 5/1972 | McGlinchey et al. | 340/572 |
| 3,668,675 | 6/1972 | Joens et al. | 340/572 |
| 4,686,513 | 8/1987 | Farrar et al. | 340/572 |
| 4,827,395 | 5/1989 | Anders et al. | 340/572 |
| 4,962,369 | 10/1990 | Close | 340/572 |
| 4,980,671 | 12/1990 | McCurdy | 340/568 |
| 5,025,246 | 6/1991 | Schenkel | 340/572 |
| 5,151,684 | 9/1992 | Johnsen | 340/572 |
| 5,154,504 | 10/1992 | Helal et al . . | |
| 5,168,263 | 12/1992 | Drucker | 340/571 |
| 5,610,587 | 3/1997 | Fukiuchi et al. | 340/572 |

FOREIGN PATENT DOCUMENTS

| | | |
|---|---|---|
| 0311036 | 4/1989 | European Pat. Off. . |
| 0429414 | 5/1991 | European Pat. Off. . |
| 0487882 | 6/1992 | European Pat. Off. . |
| 2700872 | 7/1994 | France . |

*Primary Examiner*—Jeffery Hofsass
*Assistant Examiner*—Benjamin C. Lee

[57] ABSTRACT

A method comprising combining each object with a self-contained tag containing a power source and a transmitter controlled by a sensing device to switch from a stand-by condition to an on condition in which the transmitter transmits an alarm signal to a receiver after the sensor has sensed a parameter representative of an unauthorised use of the object. Power is supplied to the transmitter only when said parameter has been sensed and the tag has received an activating signal from a transmitter associated with the receiver. The method may be used in a large controlled space such as a superstore or the like, an office building or even an industrial facility.

13 Claims, 4 Drawing Sheets

METHOD AND DEVICE FOR SENSING, IDENTIFYING AND PROTECTING GOODS, PARTICULARLY FROM THEFT

BACKGROUND OF THE INVENTION

1. Field of the Invention

This invention relates to method and device for sensing, identifying and protecting goods, particularly from theft.

It also applies to protection against unauthorised use of objects in a large controlled space such as a superstore or the like, an office building or even an industrial facility.

2. Description of the Prior Art

To perform such protection, there has already been proposed, in patent application FR 2 700 872 filed in the name of the applicant hereof, a method consisting in fitting the objects to be controlled with a tag comprising a transmitter of limited range. This transmitter is controlled by a sensing device in order to be capable of switching from a stand-by condition to an ON condition in which it transmits an alarm signal containing an identification message after the sensor has sensed a parameter representative of an unauthorised use of the object. This method further uses, in appropriate places in the controlled area, local units comprising respective receivers capable of transmitting, to a central processing unit and after reception of an alarm signal transmitted by an object, information pertaining to this object and its position at the time of the reception.

In the event of the object to be controlled having to remain stationary in a given place in the space to be controlled, the sensor can consist e.g. of an accelerometric sensor or an inclinometer capable of sensing a displacement or change of angle of the object.

It so happens that this solution has the drawback of only being usable for a very limited number of applications.

Moreover, market requirements demand the manufacture of miniature tags of the smallest possible space requirements, in order to make it possible to attach them to small objects, and yet that they be as autonomous or self-contained as possible.

However, the power consumption of tags is mainly due to the consumption of the radioelectric transmitter contained in the tag. Given the fact that the transmitter must have a minimum range that cannot be reduced, in order to increase the autonomy of the tag while limiting its power consumption it is necessary to ensure that the transmission time of the alarm signal is reduced to the strict minimum.

To this end, the utilisation of a delay circuit limiting the period of transmission from the moment said parameter is sensed, is not satisfactory. When a device is authorised to change place within a room, but without leaving the latter (the exit from the room being fitted with a receiver), the tag's power source can discharge itself subsequent to a multiplicity of authorised displacements without the receiver having been called into play.

OBJECT OF THE INVENTION

The main object of this invention is to remedy these drawbacks.

SUMMARY OF THE INVENTION

Accordingly, there is provided a method of the above-mentioned type according to which the transmitter circuit is only powered on the twofold condition that the tag has been cleared subsequent to a sensing of the above-mentioned parameter and that it receives an activating signal transmitted permanently by a transmitter device associated preferably with the receiver circuit.

Advantageously, the range of the receiver will be longer than that of the transmitter of the activating signal in order to be able to sense, over a large area, the alarm signal transmitted by the tags activated by other means or by tags responding directly to the sensing of the controlled parameter, and, in a narrower area, e.g. a transit area, the alarm signals coming from tags cleared to transmit and which have been activated by the activating signal.

Of course, the device implementing the method previously described will have to use, on the one hand, at least one local unit, possibly coupled to a central processing unit, and comprising a transmitter circuit capable of transmitting an activating signal as well as a receiver circuit capable of receiving. an alarm signal transmitted by a tag, and, on the other hand, at least one tag associated with an object to be protected comprising a receiver circuit capable of receiving the activating signal transmitted by the local unit and of transmitting an alarm signal subsequent to this reception, a sensor capable of sensing a parameter representative of unauthorised use of the object and of transmitting a clearance signal subsequent to this sensing, and a logic control circuit capable of activating the transmission of the alarm signal on the twofold condition that the clearance signal has been transmitted and that the receiver of the tag has received the activating signal.

BRIEF DESCRIPTION OF THE DRAWINGS

An embodiment of the invention will be described hereinunder, by way of a non-limiting example, in reference to the corresponding accompanying drawings in which.

DESCRIPTION OF THE PREFERRED EMBODIMENTS

As represented in these figures, the control device uses, on the one hand, associated with each object to be protected, a tag 1 comprising at least one high-frequency transmitter circuit 2 capable of generating e.g. an electromagnetic wave at a frequency of 433.92 MHz, frequency-modulated by a microcontroller, and, on the other hand, distributed over the protected space, a plurality of local units $R_1$, $R_2$, $R_3$, $R_4$ fitted with receivers tuned to the frequency of the transmitters of the tags. The different local units $R_1$, $R_2$, $R_3$, $R_4$ are connected to a central processing unit UC comprising a processor associated with peripherals such as a keyboard/ screen console CE, a printer I and possibly a system for teletransmission of alarms using voice synthesis.

The central processing unit UC can be e.g. designed to manage eight independent areas via boards managing one area each.

Figure 1:
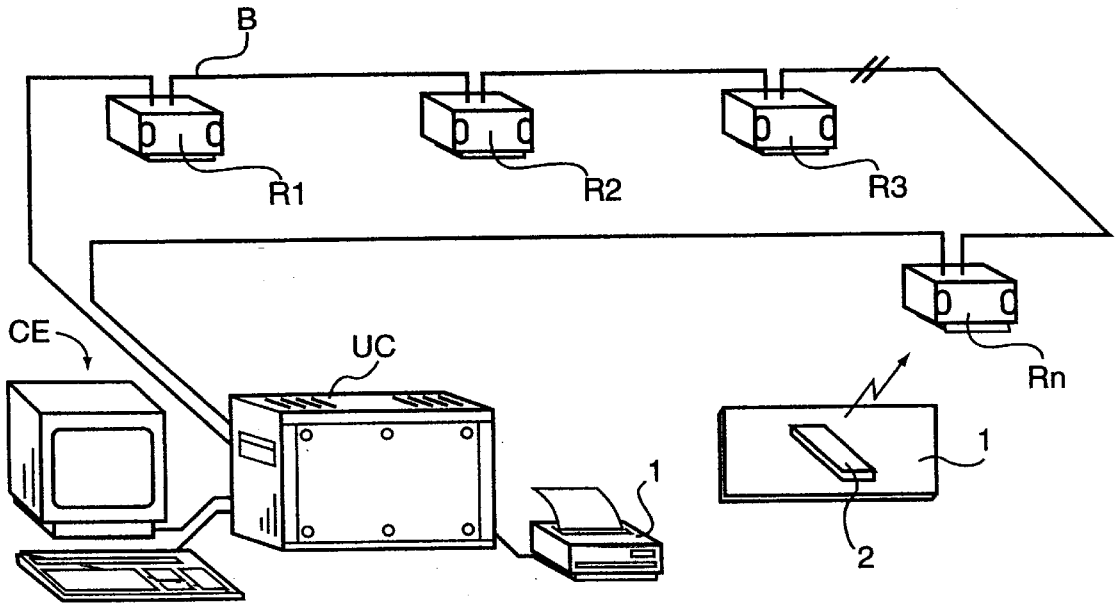
FIG. 1 is a skeleton diagram of an installation using the method according to the invention.

Each area, of which only one has been represented in FIG. 1, comprises up to one hundred and twenty-seven local units $R_1$, $R_2$, $R_3$, $R_4$ connected to one another and to the central processing unit UC via an RS 422 type network e.g. at 9600 bauds in a closed or open loop.

The central processing unit UC conducts on-going dialogue with the loops of the local units according to a specific protocol.

It stores the events in memories (hard disk) and edits them, e.g. on a printer I, as they occur.

Figure 2:
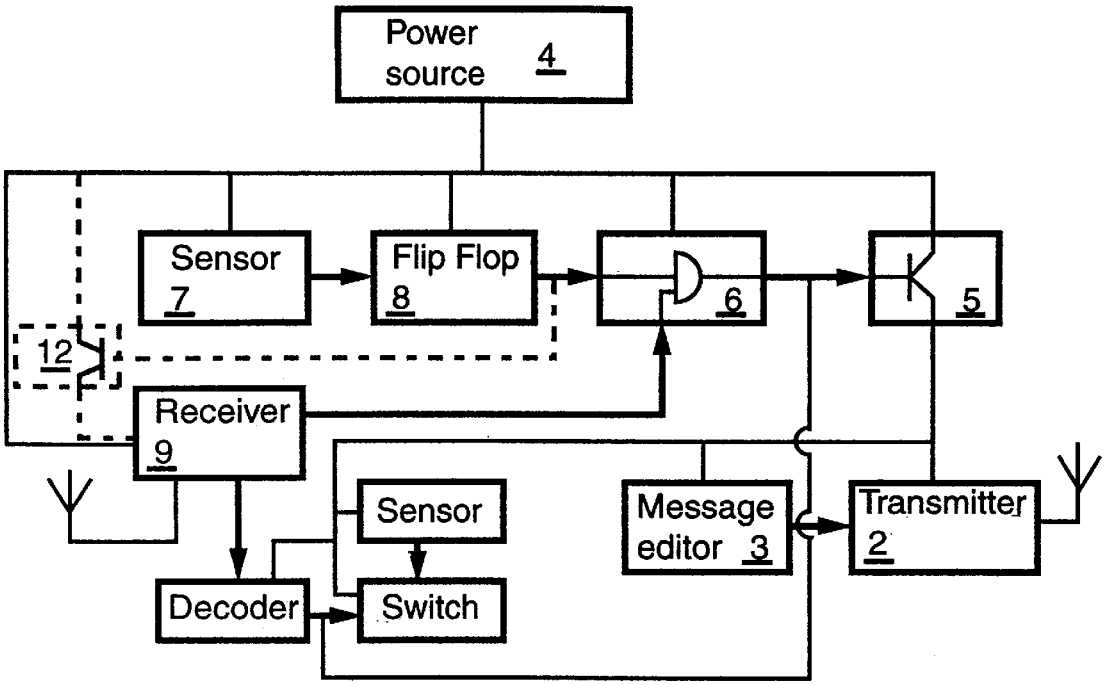
FIG. 2 is a synoptic diagram of the electronic circuit of a tag associated with a protected object.

The tags 1 equipping the objects to be controlled can comprise, as represented in FIG. 2, a high-frequency transmitter circuit 2 using an FM tuner connected to a message editor 3. This transmitter circuit 2, like the message editor 3, is powered by a power source 4, which can e.g. consist of a battery cell or an accumulator, via a controllable switch 5 (represented here by a transistor) controlled by a logic circuit 6 (indicated by a logic AND gate).

One of the two inputs of this logic circuit 6 is connected to a validating circuit comprising a sensor 7, such as e.g. an accelerometric type sensor of motion, and a monostable flip-flop 8 which enables a clearance signal of predetermined duration (monostable period) to be supplied subsequent to the sensing of an acceleration exceeding a predetermined threshold.

Figure 3:
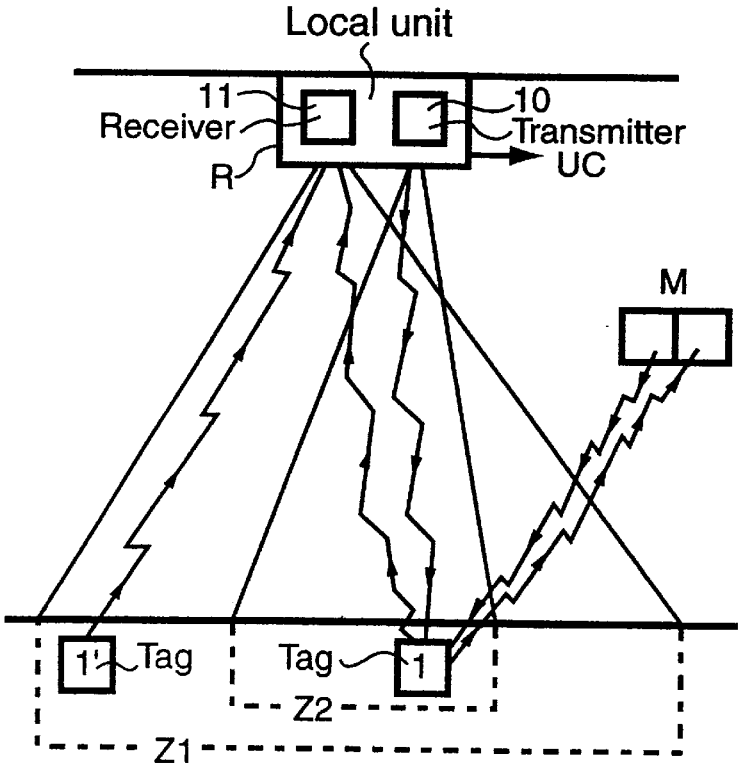
FIG. 3 schematically shows, on a larger scale, a local unit communicating with two different types of tags.

The second input of the logic circuit 6 is connected to the output of an activating circuit comprising an electromagnetic wave receiver 9 intended to receive an activating signal coming from a transmitter 10 associated with the local units R (FIG. 3).

The sensor 7, monostable flip-flop 8, logic circuit 6 and receiver 9 are permanently powered by the source 4. Conversely, the transmitter 2 and message editor 3 are powered via the controllable switch 5.

By way of these arrangements, in the absence of a sensing of the parameter controlled by the sensor 7, the switch 5 is OFF and the circuits 2 and 3 are not powered. The tag 1 therefore cannot transmit an alarm signal and only consumes a minimum quantity of power (circuits 6, 7, 8 having low power consumption).

When the sensor 7 senses the controlled parameter, this sensing triggers the transmission of a clearance signal by the monostable flip-flop 8. When the receiver 9 then receives an activating signal from the transmitter 10 of the local unit R to which it is tuned, the logic circuit 6 causes the switch 5 to be turned ON. The circuits 2 and 3 are then powered so that the editor 3 composes an alarm message which is transmitted to the local unit R by the transmitter 2.

An additional power saving can be achieved by means of the circuit represented in broken lines and by way of which the power supply to the receiver 9 of the activating signal is controlled by a controllable switch 12 triggered by the monostable flip-flop 8, so that the receiver 9 is only powered during the periods of transmission of the clearance signal.

As can be seen in FIG. 3, the range of the receivers 11 equipping the local units R is longer than the range of the activating signal transmitters 11 associated with these local units R, in order for the receiver 11 to be able to receive:

either alarm signals coming from tags 1 situated in a relatively large area Z1 and devoid of an activating circuit or whose activating circuit has been intentionally preset, which is e.g. the case of objects that must remain stationary and which must not therefore be moved, or alarm signals coming from tags 1 equipped with activating circuits and which are therefore situated within the zone Z2 of range of the activating transmitter 10 and of which the sensor has triggered the transmission of a clearance signal.

This second alternative concerns e.g. the case of tags 1 equipping objects which can be moved about within a room but which must not leave the room: the transmitter 10 of the local unit R is then disposed so that its zone of range encompasses the transit volume from the entrance door to the room.

Advantageously, the tags 1 can further comprise a circuit sensing the power level of the batteries or cells of the power source 4.

This circuit can comprise, as represented, a sensor 13 capable of measuring the voltage at the terminals of the power source 4 and which supplies a digital signal representative of this voltage to the message editor 3 via a controllable switch 14. The latter is controlled by a decoder 15 placed at the output of the activating signal receiver 9.

This sensing of the level also uses a transmitter/receiver module M which transmits to the receiver, at the request of the operator, a coded signal requesting cell level information.

When it is received by the receiver 9, this signal is decoded by the decoder 15 which causes the switches 5 and 14 to be turned ON. The sensor 13 can then measure the voltage of the source and transmit a corresponding digital information to the message editor 3.

The transmitter 2 then transmits this information to the receiver of the module M which can either display it or merely indicate whether or not the source level is sufficient.

By way of this arrangement, the user can, from a distance, check that the tags are operating properly.

The module M can further be designed to transmit a coded signal that temporarily de-activates the tag. In this case, the decoder 15 can be designed to preset the input of the logic circuit 6 for a predetermined duration, subsequent to reception by the receiver 9 of the de-activating signal.

The invention is not, of course, limited to the embodiments previously described.

Figure 6:
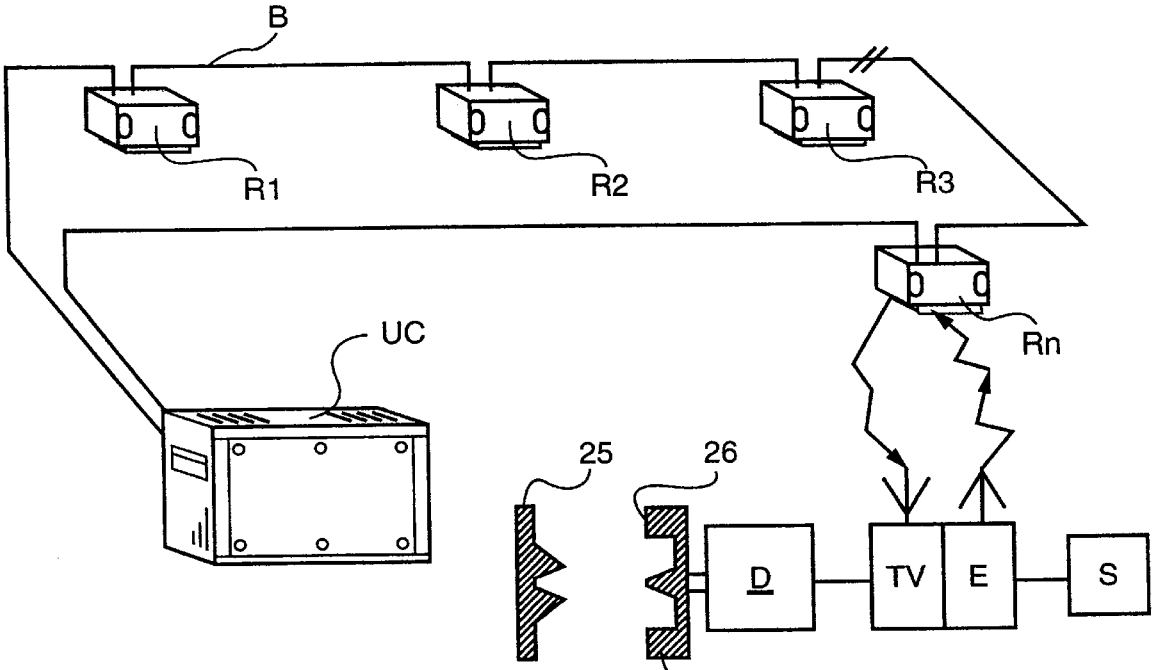
FIG. 6 is a schematic representation illustrating the operating principle of a sensing clamp in a monitoring installation of the type of the one represented in FIG. 1.
Figure 4:
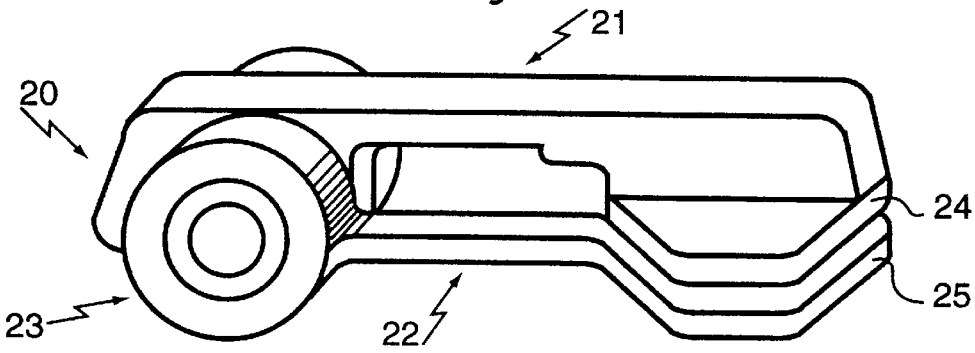
FIGS. 4 and 5 are respectively a side view and an axial cross-section of a sensing clamp usable in a device embodying the invention.
Figure 5:
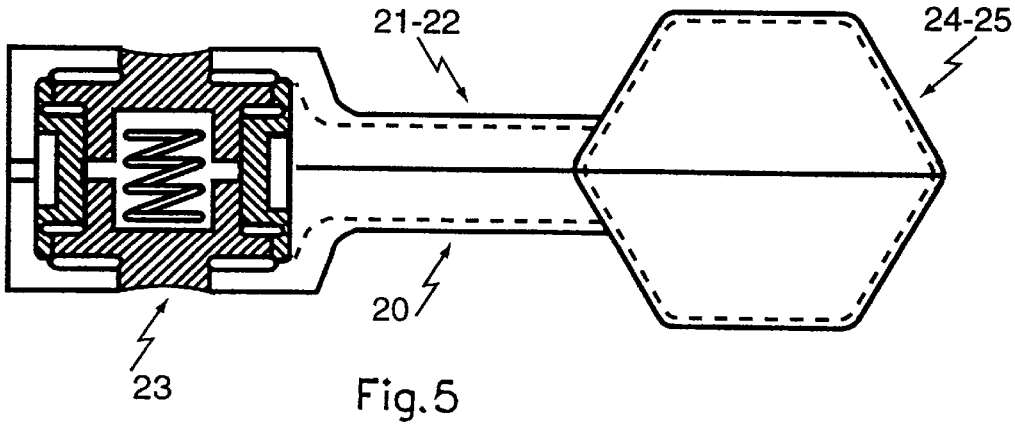

Thus, the self-contained tags 1 can consist e.g. of sensing clamps such as those illustrated in FIGS. 4 to 6 which are intended to be made integral by pinched clamping to the object to be protected (e.g. a textile object) and which comprise a sensing system designed to sense both an opening of the clamp and a tearing off of the object that was integral with the clamp.

In this example, the clamp 20 is comprised of two arms 21, 22 articulated with one another at one end by means of a disengageable free-wheel device 23 opposing the opening of the clamp 20 when in the engaged position, and of which the two other ends are equipped with two respective jaws 24, 25, one 24 of these jaws bearing an elastically deformable bearing part 26 engaged with a sensor D (e.g. a microswitch) coupled to a monitoring device TV, E powered by a renewable power source S.

As represented in FIG. 6, this monitoring device comprises a radio transmitter E of limited range controlled by the sensor D in order to be able switch from a stand-by condition to an ON condition in which the transmitter E is cleared to transmit, to a receiver $R_n$ of a monitoring network such as the one represented in FIG. 1, an alarm signal containing an identification message. This transmission can take place either immediately after the change of condition of the sensor D, or after this change, subsequent to the reception, by a receiver TV in an activating circuit associated with the clamp 20, of an activating signal transmitted by the transmitting device 10 associated with the receiver $R_n$ of the monitoring network.

The monitoring device TV, E associated with the clamp 20 can comprise a delay means enabling the transmitter E to transmit the alarm signal only for a limited duration after the change of condition of the sensor D.

Given the fact that the range of the receiver $R_n$ can be much longer than that of the transmitter 10 of the activating signal, the device embodying the invention can further use, as stationary tags, e.g. self-protected closing devices for the protection against theft of objects contained in enclosures 32 closed off by a sliding door 33.

Figure 8:
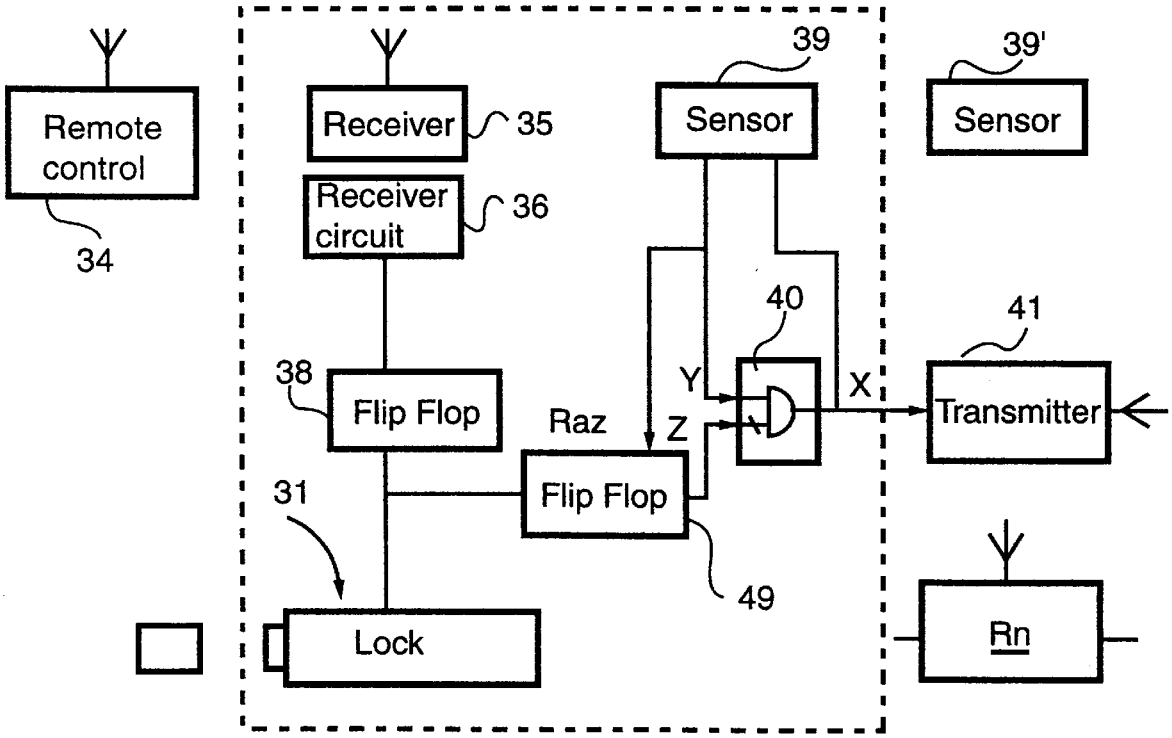
FIG. 8 is a skeleton diagram of the electronic control and theft-protection circuit equipping the electric lock represented in FIG. 7.
Figure 7:
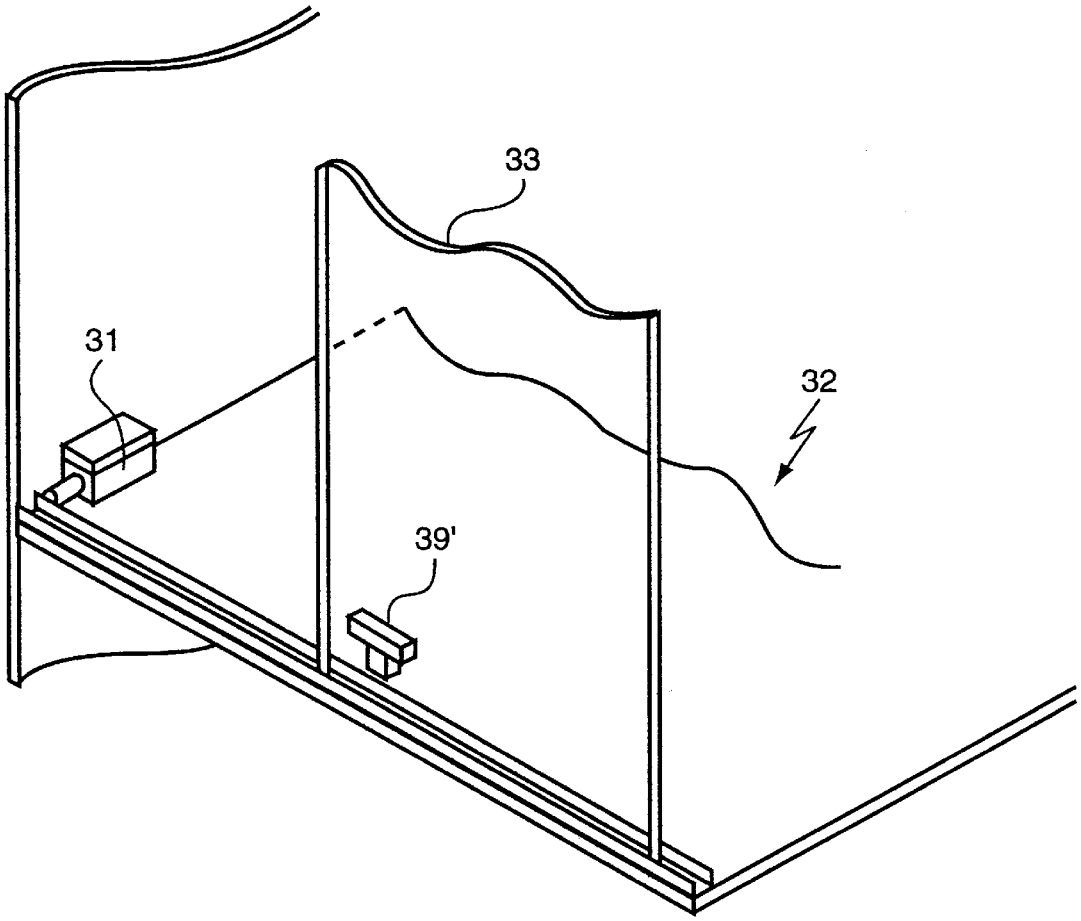
FIG. 7 is a partial schematic perspective view of a window with a sliding door equipped with an electric lock associated with a magnetic sensing device.

As represented in FIGS. 7 and 8, such a device can comprise a lock 31 disposed inside the enclosure 32 and designed to self-lock in the closed position of the door 33 and to be made switch to the unlocked position by a control signal.

This lock 31 is controlled by means of a remote control device comprising a remote control case 34 capable of transmitting a coded unlocking order, and a receiver circuit 35, 36, 38 placed within the enclosure 32 and designed to receive the unlocking order and to decode said order so as to transmit an unlocking signal to the lock 31 for a limited duration after recognition of the code.

This device further comprises:

a sensing device 39, 39' supplying a signal representative of the open or closed position of the door 33, and a processing circuit which receives the unlocking signal and the signal representative of the position of the door 33, and which transmits an alarm signal in the event of the door 33 remaining open beyond a predetermined period of time after the transmission of the unlocking signal.

The processing circuit comprises, in this instance, a first monostable flip-flop 38 triggered by the unlocking signal and which maintains the lock 31 in the unlocked condition for a sufficient period of time to enable an operator to open the door 33, and a second monostable flip-flop 49 triggered by the unlocking signal.

This second flip-flop 49 is connected to one of the inputs of a logic gate 40 of the $x=y\cdot\bar{z}$ type, of which the second input receives the signal representative of the position of the door.

The logic circuit 40 triggers the transmission, by a radio transmitter 41, of an alarm signal destined for a receiver $R_n$ of the monitoring network situated within its range in the case of the signal transmitted by the first monostable flip-flop 38 being in the "0" condition, whereas the signal supplied by the sensor 39, which is then in the "1" condition, indicates the open position of the door.

Advantageously, the sensor 39 can be connected to the resetting input of the monostable flip-flop 49 in order to cause a triggering of an alarm if the door 33 is reopened during the metastable period of the flip-flop 49, triggered subsequent to an unlocking order followed by a first opening and then a closing of the door 33.

I claim:

1. A system for sensing, identifying and protecting goods against theft, comprising:

at least one local unit placed in an appropriate place in a controlled area, comprising:

(i) a local receiver having a long range for receiving messages transmitted by a transmitter circuit located anywhere in said controlled area, and comprising means for transmitting the received alarm messages to a central processing unit, and (ii) a local transmitter having a short range for transmitting permanently an activating signal in a narrow transit area in the controlled area; and autonomous tags of at least a first and a second type, respectively fitted with objects to be protected in said controlled area, each tag comprising:

(i) an electric power source, (ii) a transmitter circuit connected to said power source via a controlled switch, said transmitter circuit when powered by said power source transmitting an alarm message containing an identification signal to said local receiver when said tag is placed in said controlled area, (iii) a sensor for sensing a parameter representative of an unauthorized use of the object fitted with the tag, (iv) a receiver circuit for receiving said activating signal when said tag is placed in said transit area, and (v) a logic control circuit connected to said power source, said transmitter and receiver circuits, said controlled switch and said sensor, for controlling said controlled switch and for switching the tag from a disabled state to an enabled state when said sensor detects said parameter, the logic control circuit of the tags of said first type comprising means for switching the transmitter on to transmit an alarm message if both said tag is in said enabled state and said receiver circuit receives said activating signal from said local transmitter, the logic control circuit of the tags of said second type comprising means for switching the transmitter on to transmit an alarm message if said tag is in said enabled state.

2. The system as claimed in claim 1, wherein the transmitter circuit of each tag is also used to transmit to said local receiver information relating to the power condition of the power source.

3. The system as claimed in claim 1, wherein each of said tags further comprises a second sensor for measuring the power level of the power source, having an output connected to a message editor associated with the transmitter circuit, via a controllable switch controlled by a decoder connected to an output of the receiver circuit, said system further comprising a transmitter/receiver module for transmitting to the receiver circuit of one of said tags, at request of an operator, a coded signal requesting information on the power level of the power source, and for receiving a response message transmitted by the transmitter circuit.

4. The system as claimed in claim 1, wherein each tag comprises a means for temporarily de-activating the tag subsequent to a reception of a coded de-activating signal.

5. The system as claimed in claim 1, wherein each of said tags comprises a sensing clamp for being made integral by pinched clamping to the object to be protected, a second sensor for sensing an opening of the clamp and a tearing off of the object that was integral with the clamp, and a means controlled by said sensor for powering said transmitter circuit in order to transmit said alarm message when said sensor senses an opening of said clamp or a tearing off of said object.

6. The system as claimed in claim 1, wherein said control circuit comprises means for maintaining said tag in said enabled state for a limited duration after said sensor senses said parameter.

7. The system as claimed in claim 1, wherein said logic control circuit has a first input connected to an enabling circuit comprising said sensor a monostable flip-flop, and a second input connected to an output of said receiver circuit tuned to said local transmitter of the local unit.

8. The system as claimed in claim 7, wherein each tag further comprises a second controllable switch for controlling powering of said receiver circuit, controlled by said monostable flip-flop.

9. A system for sensing, identifying and protecting goods against theft, comprising:

at least one local unit placed in an appropriate place in a controlled area, comprising a local receiver having a long range for receiving alarm messages transmitted by a transmitter circuit located anywhere in said controlled area, and comprising means for transmitting the received alarm messages to a central processing unit; and autonomous tags respectively fitted with objects to be protected in said controlled area, each tag comprising:

(i) an electric power source, (ii) transmitter and receiver circuits connected to said power source via a controlled switch, said transmitter circuit when powered by said power source transmitting an alarm message containing an identification signal to said local receiver when said tag is placed in said controlled area, (iii) a sensing clamp for being made integral by pinched clamping to the object to be protected, comprising a clamp and a sensor for sensing an opening of the clamp and a tearing off of the object integral with the clamp, said clamp comprising two arms articulated with one another at one end by means of a disengageable free-wheel device opposing the opening of the clamp when in an engaged position, and (iv) a logic control circuit connected to said power source, said transmitter and receiver circuits, said controlled switch and said sensor, and comprising means for switching the transmitter on to transmit an alarm message if said sensor senses an opening of the clamp or a tearing off of the object.

10. A system as claimed in claim 9 wherein said local unit further comprises a local transmitter having a short range for transmitting permanently an activating signal in a narrow transit area in the controlled area, each of said tags comprising a second sensor for sensing a parameter representative of an unauthorized use of the object fitted with the tag, and a receiver circuit for receiving said activating signal when said tag is placed in said transit area, said logic control circuit of said tag further comprising means for switching the tag from a disabled state to an enabled state when said second sensor detects said parameter, and for switching the transmitter on to transmit an alarm message if both said tag is in said enabled state and said receiver circuit receives said activating signal from said local transmitter.

11. A system for sensing, identifying and protecting goods against theft, comprising:

at least one local unit placed in an appropriate place in a controlled area, comprising:

(i) a local receiver having a long range for receiving alarm messages transmitted in said controlled area, and comprising means for transmitting the received alarm messages to a central processing unit, and (ii) a local transmitter having a short range for transmitting permanently an activating signal in a narrow transit area in the controlled area; and at least one autonomous tag fitted with an enclosure placed in said controlled area and in which an object to be protected is disposed, said enclosure comprising a door having a closed position and an opened position, and a lock for self-locking the door in its closed position, which can be unlocked by an unlocking control signal, said tag comprising:

(i) an electric power source, (ii) a transmitter circuit connected to said power source via a controlled switch, said transmitter circuit when powered transmitting an alarm message containing an identification signal to said local receiver, (iii) a sensor for detecting the opened and closed positions of the door, (iv) a receiver circuit for receiving said unlocking signal generated by a remote control, (v) a processing circuit connected to said transmitter and receiver circuits, said controlled switch, said lock and said sensor, for unlocking the lock if the receiver received said unlocking signal and for switching the transmitter on to transmit an alarm message if the door remains open beyond a predetermined period of time after receiving the unlocking signal.

12. The system as claimed in claim 11, wherein said processing circuit comprises a means for switching the transmitter on if the door is reopened during a metastable period triggered subsequent to an unlocking order followed by a first opening and then a closing of the door.

13. A system for sensing, identifying and protecting goods against theft, comprising:

at least one local unit placed in an appropriate place in a controlled area, comprising:

(i) a local receiver having a long range for receiving messages transmitted by a transmitter located anywhere in said controlled area, and comprising means for transmitting the received alarm messages to a central processing unit, and (ii) a local transmitter having a short range for transmitting permanently an activating signal in a narrow transit area in the controlled area; and autonomous tags of a first, a second and a third type, respectively fitted with objects to be protected in said controlled area, said tags of the third type being fitted with a respective enclosure placed in said controlled area and in which an object to be protected is disposed, said enclosure comprising a door having a closed position and an opened position, and a lock for self-locking the door in its closed position, which can be unlocked by an unlocking control signal, each tag comprising:

(i) an electric power source, (ii) a transmitter circuit connected to said power source via a controlled switch, said transmitter circuit when powered by said power source transmitting an alarm message containing an identification signal to said local receiver when said tag is placed in said controlled area, (iii) a sensor for sensing a parameter representative of an unauthorized use of the object fitted with the tag, said parameter in the tags of the third type being the opened position of said door, (iv) a receiver circuit, the receiver circuit of the tags of the first and second type comprising means for receiving said activating signal when said tag is placed in said transit area, the receiving circuit of the tags of the third type comprising means for receiving said unlocking signal generated by a remote control, and (v) a logic control circuit connected to said power source, said transmitter and receiver circuits, said controlled switch and said sensor for controlling said controlled switch and for switching the tag from a disabled state to an enabled state when said sensor detects said parameter, the logic control circuit of the tags of said first type comprising means for switching the transmitter on to transmit an alarm message if both said tag is in said enabled state and said receiver circuit receives said activating signal from said local transmitter, the logic control circuit of the tags of said second and third type being connected to the lock and comprising means for switching the transmitter on to transmit an alarm message if said tag is in said enabled state, the logic control circuit of the tags of said third type comprising means for unlocking the lock when said receiver circuit receives said unlocking signal, and for switching the transmitter on to transmit an alarm message if said tag remains in said enabled state beyond a predetermined period of time after receiving said unlocking signal.

* * * * *